US011920444B1

(12) United States Patent
Binstock

(10) Patent No.: US 11,920,444 B1
(45) **Date of Patent: *Mar. 5, 2024**

(54) TRAVELING VALVE ASSEMBLY FOR RECIPROCATING ROD PUMPS

(71) Applicant: Jordan Binstock, South Heart, ND (US)

(72) Inventor: Jordan Binstock, South Heart, ND (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/089,066

(22) Filed: Dec. 27, 2022

Related U.S. Application Data

(63) Continuation of application No. 18/056,870, filed on Nov. 18, 2022.

(51) Int. Cl.
*E21B 43/12* (2006.01)
*E21B 34/14* (2006.01)

(52) U.S. Cl.
CPC ..... *E21B 43/127* (2013.01); *E21B 34/142* (2020.05); *E21B 2200/04* (2020.05)

(58) Field of Classification Search
CPC ... E21B 43/127; E21B 34/142; E21B 2200/04
See application file for complete search history.

(56) References Cited

U.S. PATENT DOCUMENTS

| | | | | |
|---|---|---|---|---|
| 1,977,915 | A * | 10/1934 | Mowrey | F04B 47/00 166/105.4 |
| 5,941,311 | A * | 8/1999 | Newton | E21B 43/12 417/444 |
| 2015/0075637 | A1* | 3/2015 | Gronning | E21B 34/08 137/515 |
| 2020/0011154 | A1* | 1/2020 | Stachowiak, Jr. | E21B 34/142 |
| 2021/0246992 | A1* | 8/2021 | Ford | F16K 15/04 |

OTHER PUBLICATIONS

American Heritage Dictionary : Dome—https://www.ahdictionary.com/word/search.html?q=dome (Year: 2023).*

* cited by examiner

*Primary Examiner* — David Carroll
(74) *Attorney, Agent, or Firm* — Fargo Patent & Business Law; Thomas Kading

(57) ABSTRACT

A traveling valve assembly for a downhole pump includes a traveling valve housing comprising a shouldered lower section; a valve seat within the traveling valve housing and adjacent to the shouldered lower section; a traveling valve cage insert within the traveling valve housing and adjacent to the valve seat; and a valve ball adjacent to the valve seat and within the traveling valve cage insert.

8 Claims, 10 Drawing Sheets

TRAVELING VALVE ASSEMBLY FOR RECIPROCATING ROD PUMPS

BACKGROUND

The present disclosure relates to reciprocating rod pumps, and more specifically to a traveling valve assembly therefor.

Oil wells are often equipped with reciprocating pump systems to bring oil to the surface. Reciprocating pump systems, such as sucker rod pump systems, extract fluids from the well and employ a downhole pump connected to a driving source at the surface. A sucker rod string connects the surface driving force to the downhole pump in the well. When operated, the driving source cyclically raises and lowers the downhole pump, and with each stroke, the downhole pump lifts well fluids toward the surface.

While reciprocating pump systems have proven to be economical and reliable, they may still experience certain shortcomings typically associated with the valves which are generally of the ball and seat variety.

SUMMARY

A traveling valve assembly for a downhole pump according to one disclosed non-limiting embodiment of the present disclosure includes a traveling valve housing comprising a shouldered lower section; a valve seat within the traveling valve housing and adjacent to the shouldered lower section; a traveling valve cage insert within the traveling valve housing and adjacent to the valve seat; and a valve ball adjacent to the valve seat and within the traveling valve cage insert.

A further embodiment of any of the foregoing embodiments of the present disclosure includes that the traveling valve housing comprises an internally threaded upper section.

A further embodiment of any of the foregoing embodiments of the present disclosure includes that the internally threaded upper section threads onto a plunger of a downhole pump.

A further embodiment of any of the foregoing embodiments of the present disclosure includes that the shouldered lower section forms an inner diameter that is 70%-75% of an inner diameter of the traveling valve housing.

A further embodiment of any of the foregoing embodiments of the present disclosure includes that the shouldered lower section forms an inner diameter that is 71% of an inner diameter of the traveling valve housing.

A further embodiment of any of the foregoing embodiments of the present disclosure includes that the traveling valve cage insert comprises a cylindrical open lower section and an arched open upper section opposite thereto.

A further embodiment of any of the foregoing embodiments of the present disclosure includes that the arched open upper section comprises three (3) axial arched rails.

A further embodiment of any of the foregoing embodiments of the present disclosure includes that the three (3) axial arched rails form an arched dome that operate to stop the ball yet permit fluid to be communicated therethrough.

A further embodiment of any of the foregoing embodiments of the present disclosure includes that the traveling valve cage insert is monolithic.

A further embodiment of any of the foregoing embodiments of the present disclosure includes that the traveling valve housing is monolithic.

A downhole pump according to one disclosed non-limiting embodiment of the present disclosure includes a pump barrel; a standing valve assembly attached to the pump barrel; and a traveling valve assembly located in the pump barrel above the standing valve assembly, the traveling valve assembly comprises a traveling valve housing within which a valve seat is located adjacent to a shouldered lower section of the traveling valve housing, a traveling valve cage insert is within the traveling valve housing adjacent to a valve seat, and a valve ball is adjacent to the valve seat and within the traveling valve cage insert.

A further embodiment of any of the foregoing embodiments of the present disclosure includes that the traveling valve housing comprises an internally threaded upper section.

A further embodiment of any of the foregoing embodiments of the present disclosure includes that the internally threaded upper section threads onto a plunger of the downhole pump.

The foregoing features and elements may be combined in various combinations without exclusivity, unless expressly indicated otherwise. These features and elements as well as the operation thereof will become more apparent in light of the following description and the accompanying drawings. It should be appreciated however that the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
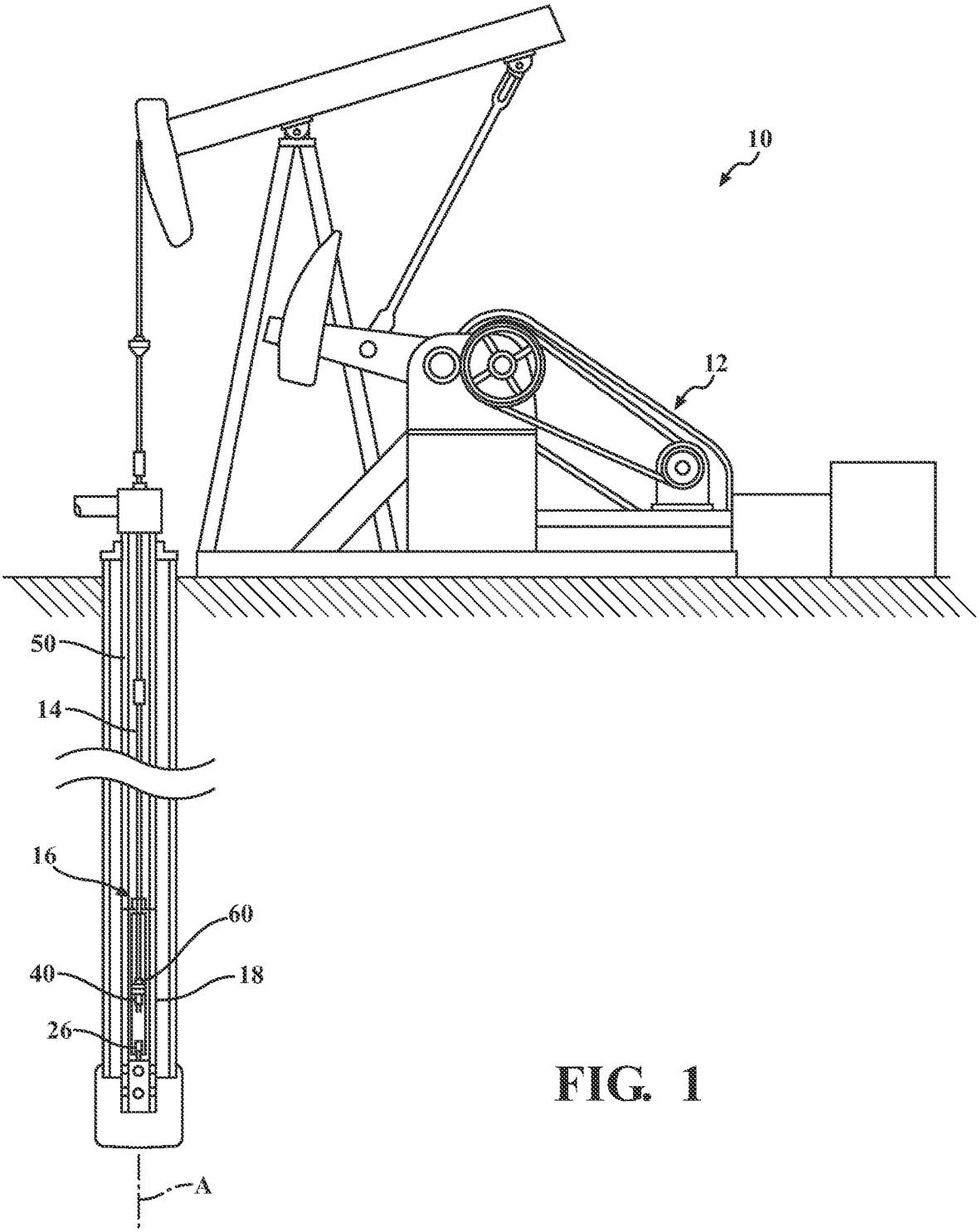
FIG. 1 is a schematic view of an example downhole rod pump system.

FIG. 1 schematically illustrates a downhole rod pump system 10 that is used to produce fluid from a well. The downhole rod pump system 10 generally includes a surface unit 12 that is connected by a rod string 14 to a downhole pump 16. The surface unit 12 cycles the rod string 14 and thereby the downhole pump 16.

The downhole pump 16 includes a pump barrel 18. The pump barrel 18 of the downhole pump 16 supports a standing valve assembly 26 located in a lower portion thereof. The standing valve assembly 26 typically includes a cage, a ball, and a seat, to allow the fluid to enter the downhole pump 16 from a wellbore. The pump barrel 18 of the downhole pump 16 also houses a traveling valve assembly 40 above the standing valve assembly 26. The traveling valve assembly allows fluid communication from the pump barrel 18 of the downhole pump 16 into a production tube 50 for communication of the fluid to the surface but prevents fluid return from the production tube 50 into the pump barrel 18.

Figure 2:
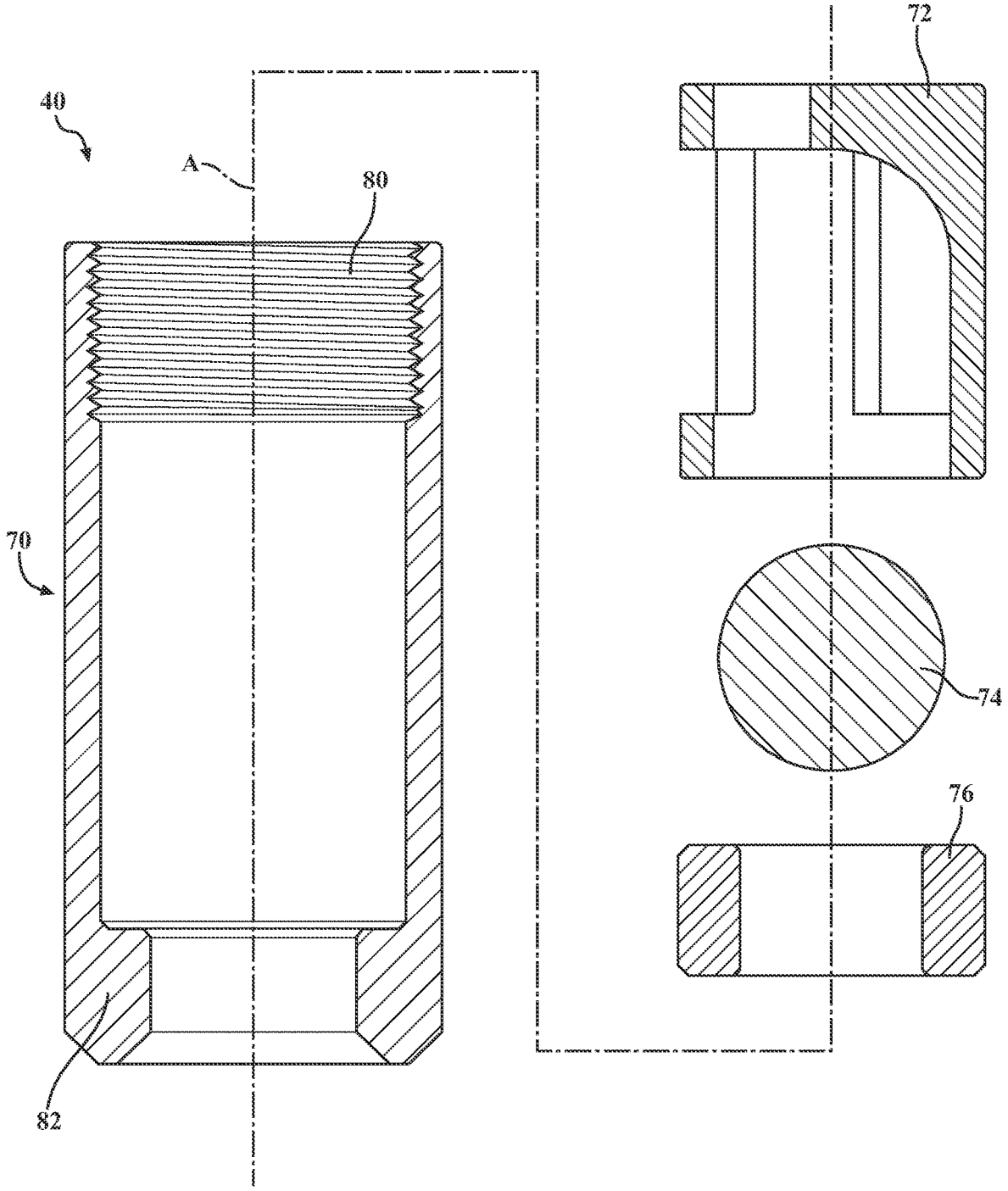
FIG. 2 is an exploded view of a traveling valve assembly according to one disclosed non-limiting embodiment.
Figure 3A:
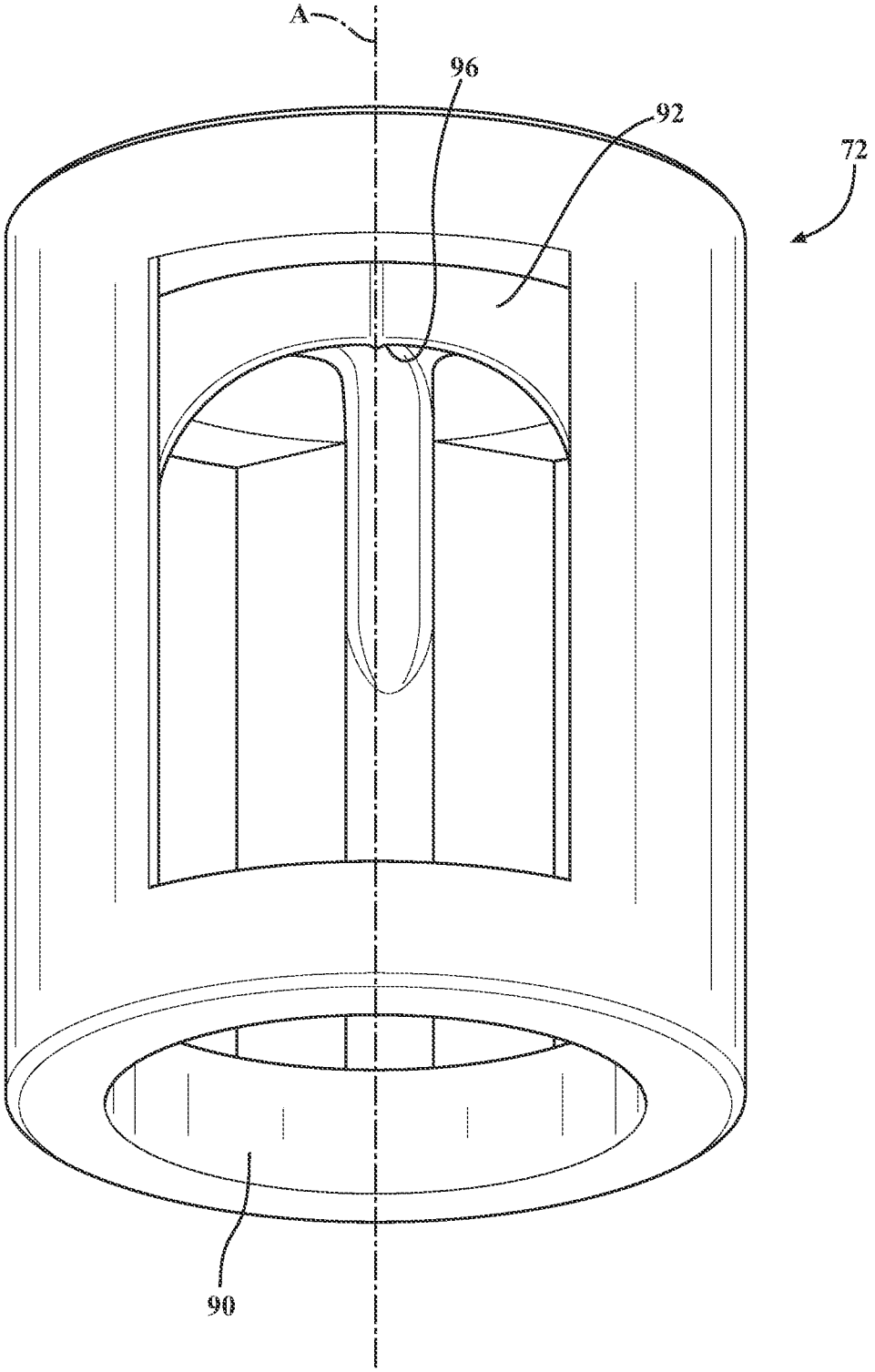
FIG. 3A is a perspective view of the traveling valve cage insert.
Figure 3B:
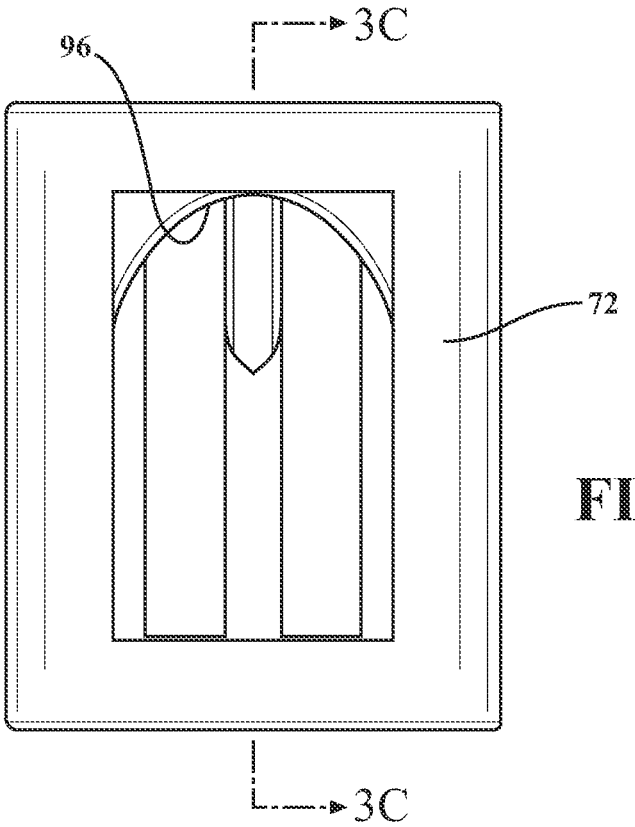
FIG. 3B is a side view of the traveling valve cage insert.
Figure 3C:
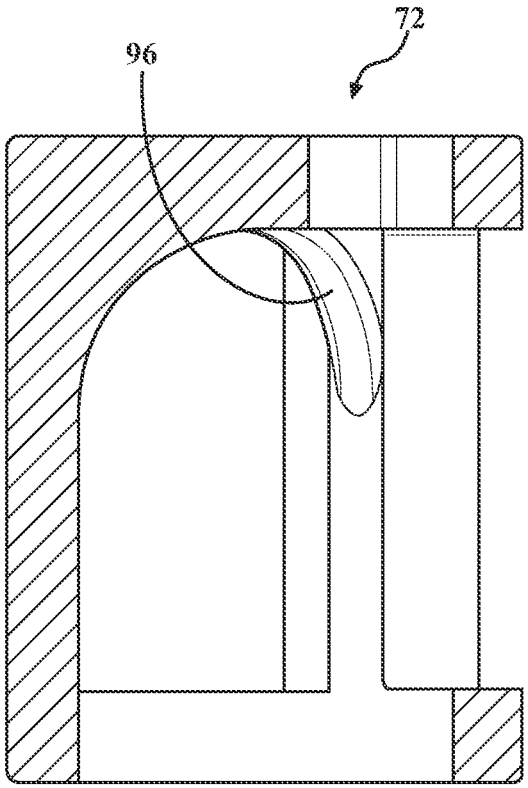
FIG. 3C is a sectional view of the traveling valve cage insert taken along line 3C-3C in FIG. 3B.
Figure 3D:
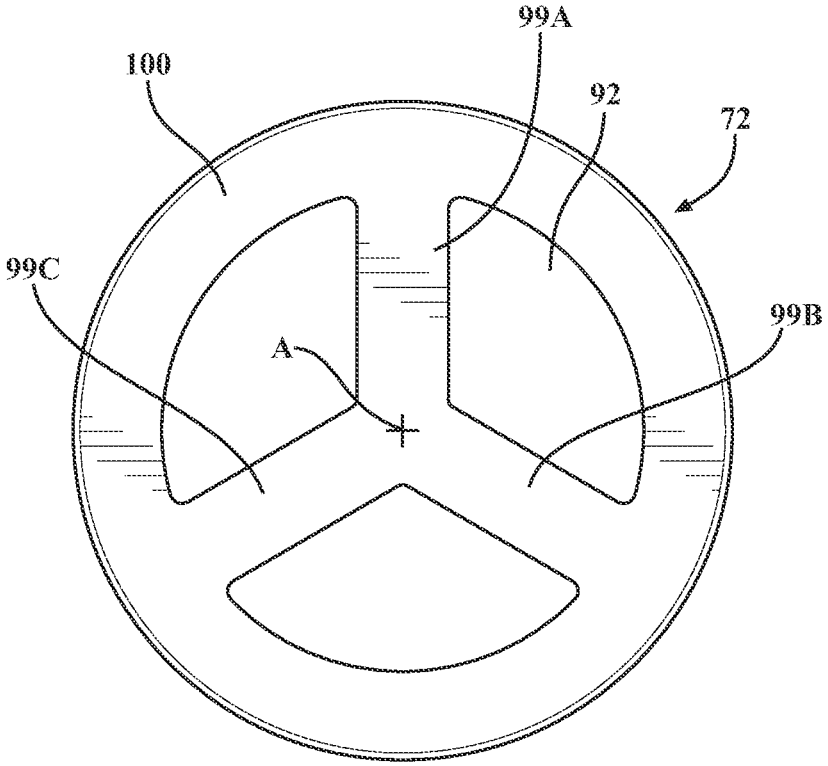
FIG. 3D is a top view of the traveling valve cage insert.
Figure 3E:
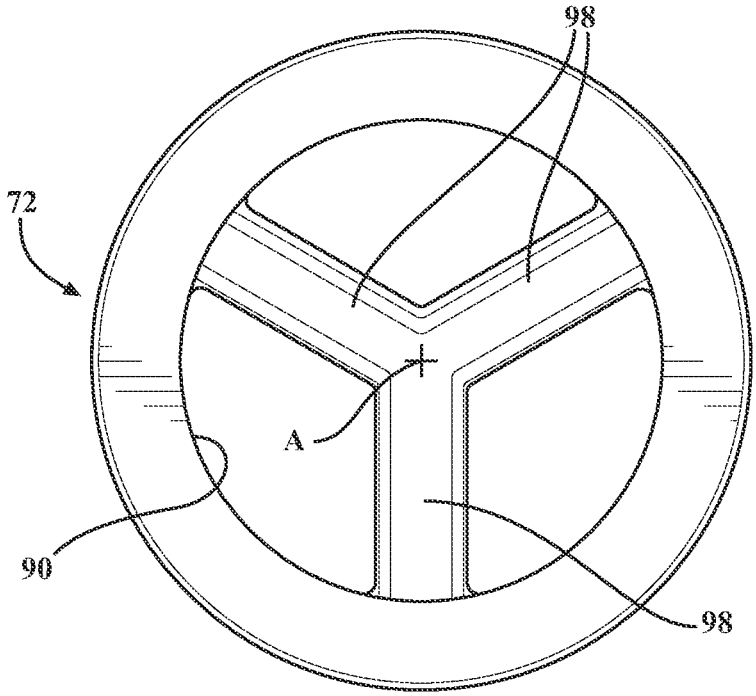
FIG. 3E is a bottom view of the traveling valve cage insert.
Figure 4A:
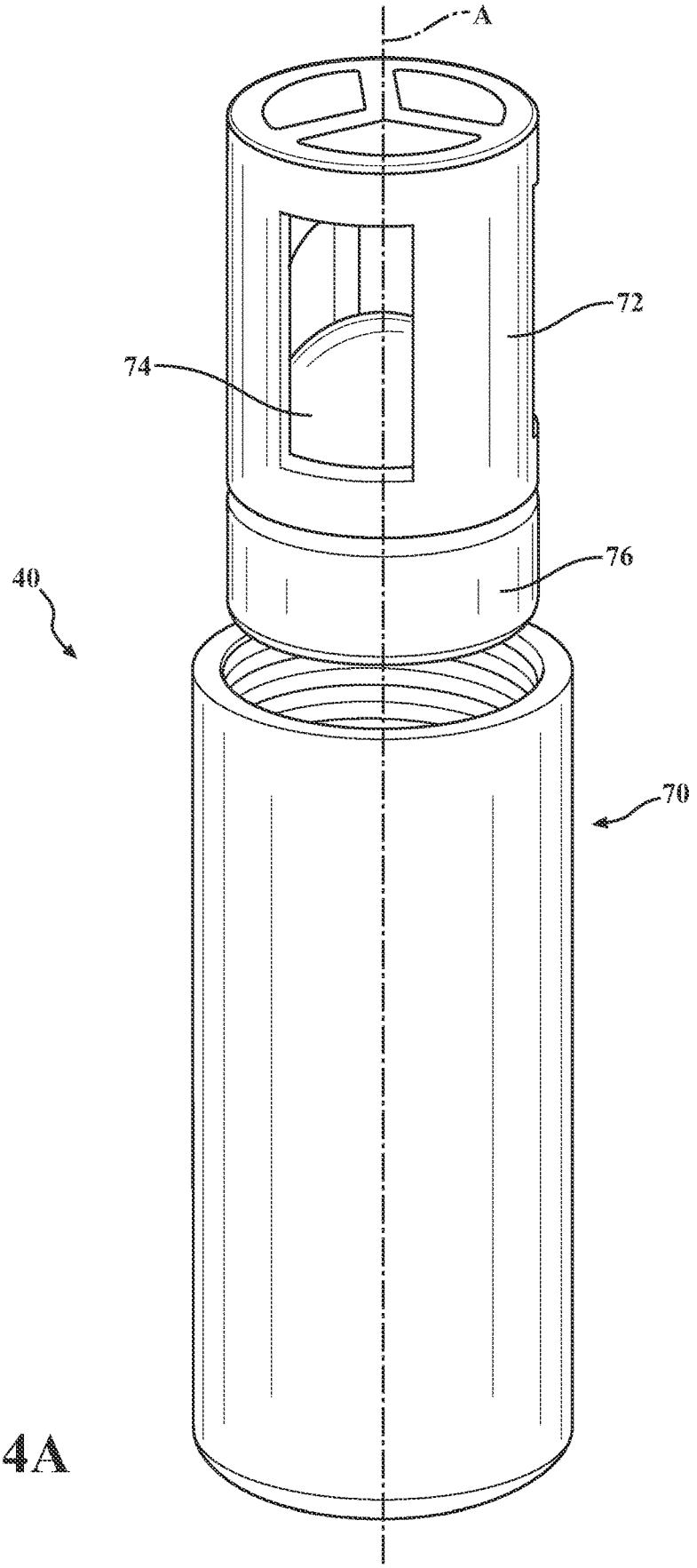
FIG. 4A is a partial exploded view of the traveling valve assembly.
Figure 4B:
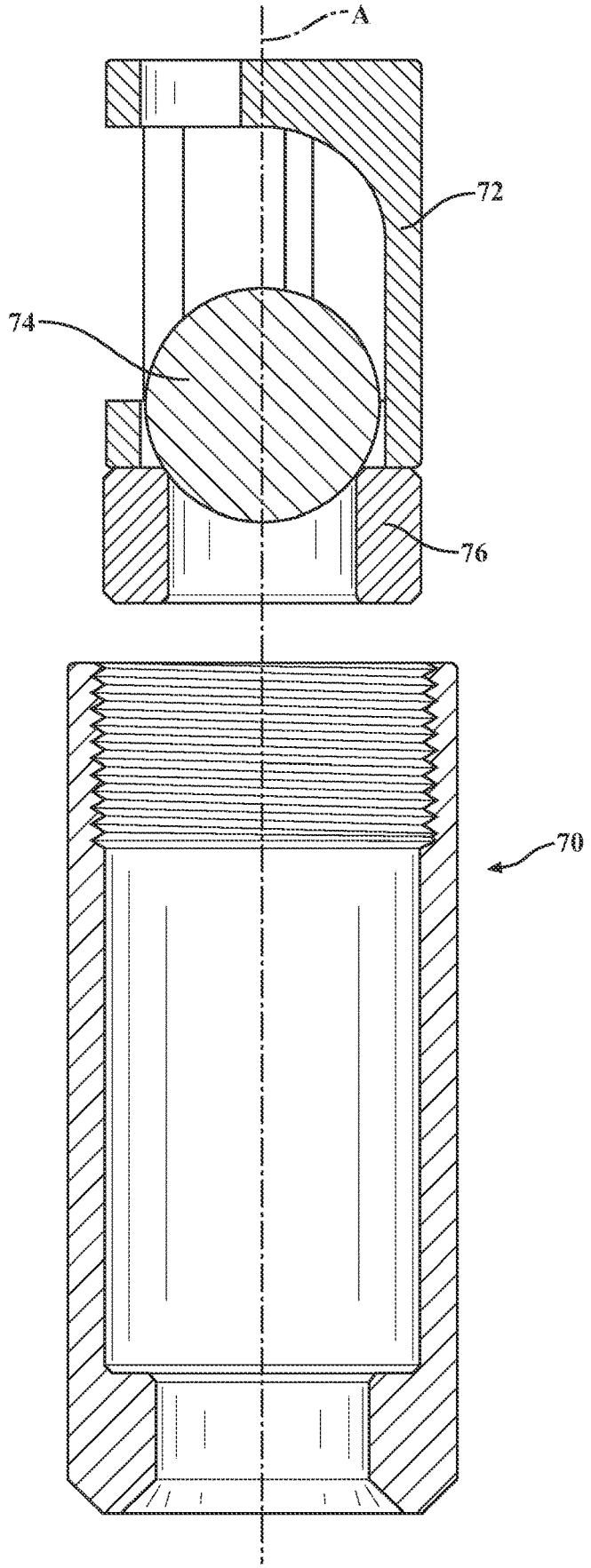
FIG. 4B is a sectional view of the traveling valve assembly as shown in FIG. 4A.
Figure 5:
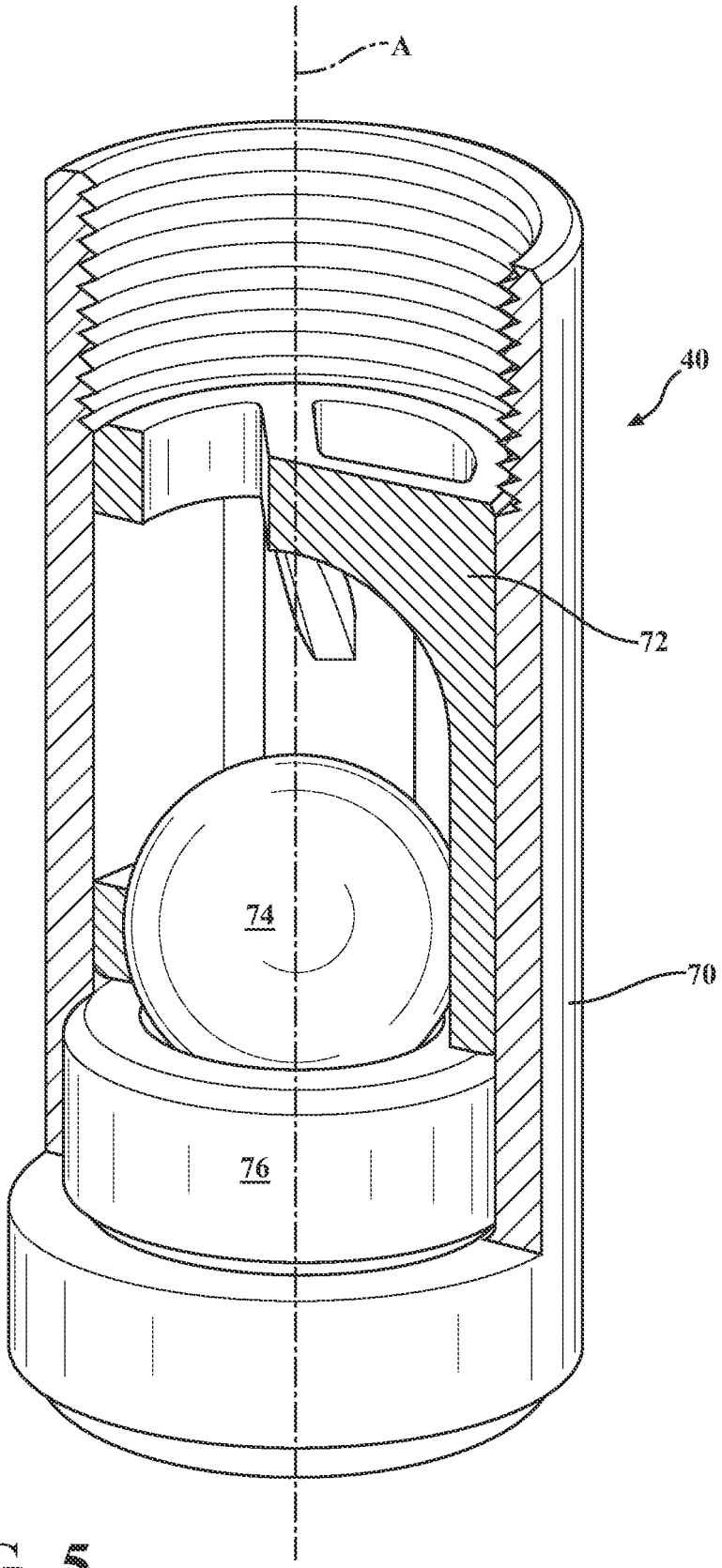
FIG. 5 is a sectional view of the traveling valve assembly in a closed condition.

With reference to FIG. 2, the traveling valve assembly 40 includes a traveling valve housing 70 that contains a traveling valve cage insert 72 (FIG. 3A-3E), which in turn, contains, a ball 74, and a seat 76 (FIG. 4A-4B). The seat 76 is assembled into the traveling valve housing 70, the ball 74 is inserted within the traveling valve cage insert 72, then the traveling valve cage insert 72 with the ball 74 therein is assembled into the traveling valve housing 70 such that the ball 74 rests on the seat 76 (FIG. 5).

Figure 6:
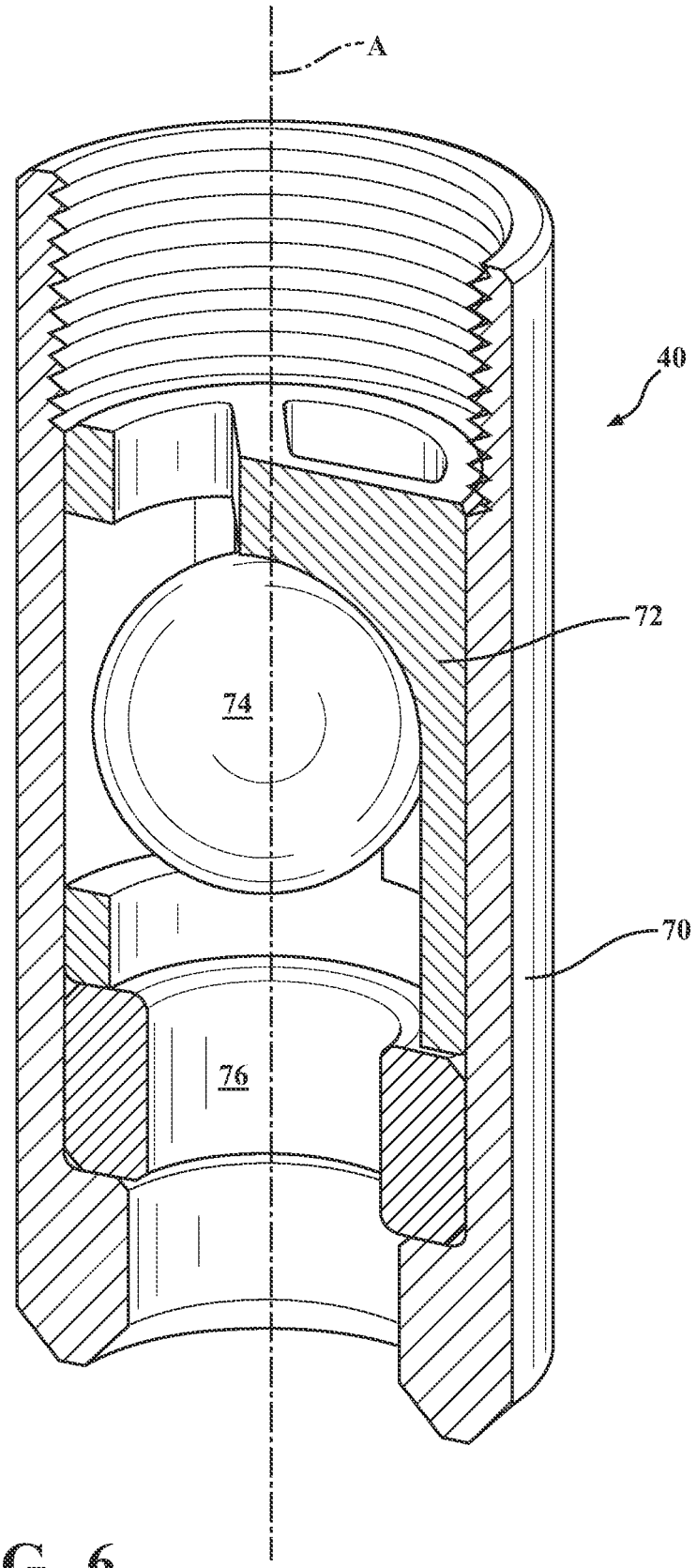
FIG. 6 is a sectional view of the traveling valve assembly in an open condition.

During the upstroke, the traveling valve assembly 40 is closed (FIG. 5), and any fluid above the seal between the ball 74, and the seat 76 is lifted towards the surface. Meanwhile, the standing valve assembly 26 opens and allows fluid to enter the pump barrel 18 from the wellbore. During the downstroke, the traveling valve assembly 40 is opened (FIG. 6) by the ball 74 being displaced from the seat 76, and the standing valve assembly 26 is closed. Previously drawn fluid within the pump barrel 18 can then enter into the production tubing 50 for communication to the surface.

With continued reference to FIG. 2, the traveling valve housing 70 is generally cylindrical and includes an internally threaded upper section 80 and a shouldered lower section 82. The internally threaded upper section 80 threads to the rod string 14 at a plunger 60 (FIG. 1). The traveling valve assembly 40 eliminates the need for a traveling valve plug by utilizing the lower shouldered section and the connection between the traveling valve housing 70 and the plunger 60 to secure the cage components and generate a seal surface that provides valve function integrity.

The shouldered lower section 82 supports the seat 76 which supports the traveling valve cage insert 72 within which the ball 74 is movable along axis A. That is, the shouldered lower section 82 provides a reduced inner diameter that operates as a stop and a support for the seat 76 to be assembled into the traveling valve housing 70 and thereby be supported within the traveling valve housing 70. In one embodiment, the shouldered lower section 82 forms an inner diameter that is 70%-75% of an inner diameter of the traveling valve housing 70. In another embodiment, the shouldered lower section 82 forms an inner diameter that is 71% of an inner diameter of the traveling valve housing 70.

With reference to FIG. 3A-3E, the traveling valve cage insert 72 is generally cylindrical and includes a cylindrical open lower section 90 and an arched open upper section 92 opposite thereto. The arched open upper section 92 in the disclosed non-limiting embodiment includes three (3) axial arched rails 99A, 99B, 99C along the axis A. The axial arched rails 99A, 99B, 99C provide an effective guide for the ball 74 to facilitate a more direct hit on the seat 76 which reduces wear.

The axial arched rails 99A, 99B, 99C together form an arched dome 96 (best seen in FIGS. 3A, 3B and 3C) that operate to stop the ball 74 (FIG. 6) yet permits fluid to be communicated around the ball 74 and through the traveling valve cage insert 72 when the ball 74 is off the seat 76. The arched dome 96 also provides greater axial clearance to increase fluid flow.

The axial arched rails 99A, 99B, 99C that form the arched dome 96 may each be chamfered 98 (FIG. 3E) to facilitate flow of the fluid thereby. That is, the chamfered 98 axial arched rails 99A, 99B, 99C that form the arched dome 96 minimizes turbulence of the fluid flow.

The assembly torque of threading the internally threaded upper section 80 to the plunger 60 retains the internal components of the valve cage insert 72, ball 74 and seat 76, which were previously inserted into the traveling valve housing 70 from the internally threaded upper section 80 to achieve a metal-to-metal seal for proper operation of the traveling valve assembly 40. That is, a top surface 100 (FIG. 3D) of the traveling valve cage insert 72 may be machined to facilitate a seal with the plunger 60. The monolithic traveling valve cage insert 72 also eliminates the heretofore required bottom traveling valve plug.

Figure 7:
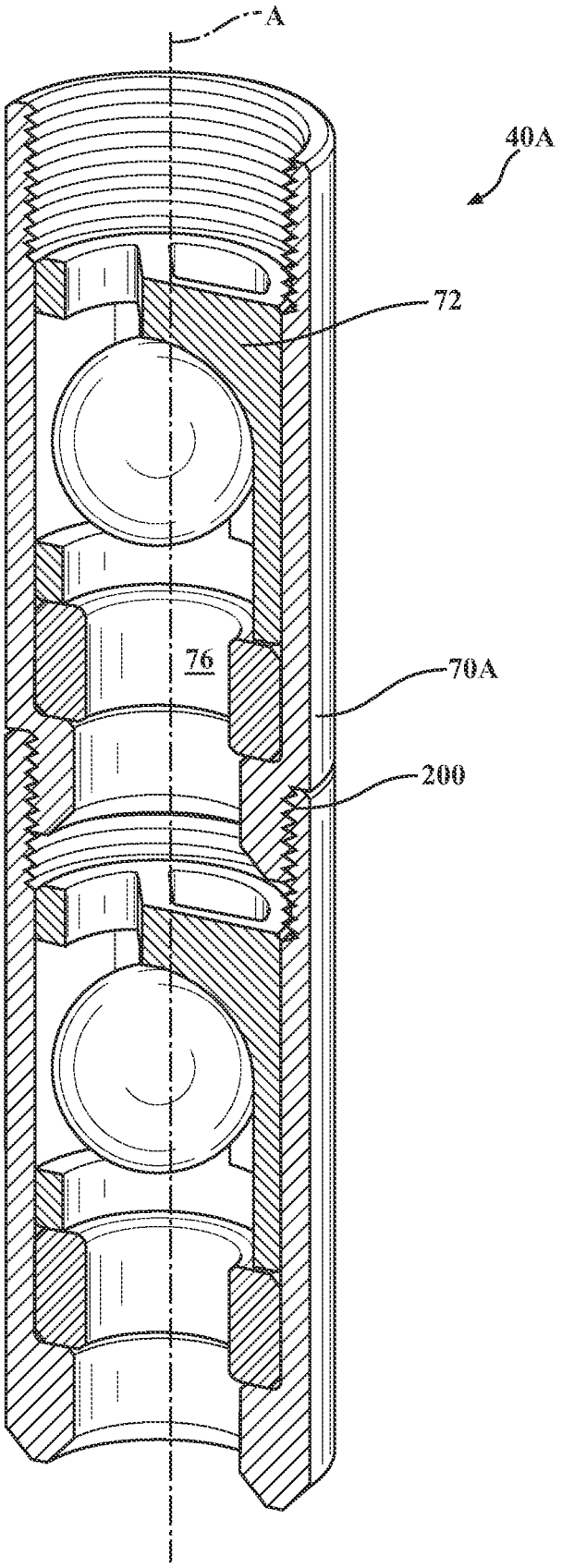
FIG. 7 is a sectional view of a traveling valve assembly according to another disclosed non-limiting embodiment.

With reference to FIG. 7, in another embodiment of traveling valve assembly the traveling valve housing 70A includes an externally threaded lower section 200. The externally threaded lower section 200 facilitates the threaded attachment of a primary traveling valve assembly 40 to the traveling valve assembly 40A as a secondary which also threads to the plunger 60. The primary and secondary traveling valve assembly thereby increases the throughput as well as maintains a seal surface that provides valve function integrity. Although a primary and a secondary are disclosed in the illustrated embodiment, it should be appreciated that any number of traveling valve assemblies may be so configured.

The traveling valve assembly 40 provides for increased valve life, reduced connections, more efficient fluid flow, and durability.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. A traveling valve assembly for a downhole pump, comprising:

a traveling valve housing comprising a shouldered lower section, the traveling valve housing comprises an internally threaded upper section, wherein the internally threaded upper section threads onto a plunger of a downhole pump;

a valve seat within the traveling valve housing and adjacent to the shouldered lower section;

a traveling valve cage insert within the traveling valve housing and adjacent to the valve seat, the traveling valve cage insert comprises a cylindrical open lower section and an arched open upper section opposite thereto, the arched open upper section comprises three (3) axial arched rails that form an arched dome that operate to stop a valve ball yet permit fluid to be communicated therethrough, wherein a top surface of the traveling valve cage insert is machined to form a metal-to-metal seal with the plunger; and the valve ball adjacent to the valve seat and within the traveling valve cage insert.

2. The traveling valve assembly as recited in claim 1, wherein the shouldered lower section forms an inner diameter that is 71% of an inner diameter of the traveling valve housing.

3. The traveling valve assembly as recited in claim 1, wherein the traveling valve cage insert comprises a cylindrical open lower section and an arched open upper section opposite thereto.

4. The traveling valve assembly as recited in claim 1, wherein the traveling valve cage insert is monolithic.

5. The traveling valve assembly as recited in claim 4, wherein the traveling valve housing is monolithic.

6. A downhole pump, comprising:

a pump barrel;

a standing valve assembly located in the pump barrel; and a traveling valve assembly located in the pump barrel above the standing valve assembly, the traveling valve assembly comprises a traveling valve housing within which a valve seat is located adjacent to a shouldered lower section of the traveling valve housing, wherein the traveling valve housing comprises an internally threaded upper section that threads onto a plunger of the downhole pump, a traveling valve cage insert is within the traveling valve housing adjacent to the valve seat, and a valve ball is adjacent to the valve seat and within the traveling valve cage insert, wherein the traveling valve cage insert comprises a cylindrical open lower section and an arched open upper section opposite thereto, the arched open upper section comprises three (3) axial arched rails that form an arched dome that operate to stop the valve ball yet permit fluid to be communicated therethrough, wherein an assembly torque of threading the internally threaded upper section to the plunger retains the internal components of the valve cage insert, the valve ball, and the valve seat, wherein a top surface of the traveling valve cage insert is machined to form a metal-to-metal seal with the plunger.

7. The downhole pump as recited in claim 6, wherein the axial arched rails are each chamfered.

8. The traveling valve assembly as recited in claim 1, wherein an assembly torque of threading the internally threaded upper section to the plunger of the downhole pump retains the internal components of the valve cage insert, the valve ball, and the valve seat.

* * * * *